United States Patent [19]

Bourne

[11] Patent Number: 4,974,134

[45] Date of Patent: Nov. 27, 1990

[54] ILLUMINATION DEVICE HAVING UNDERGROUND STORAGE POSITION

[76] Inventor: Steven M. Bourne, 6800 298th Ave., Clearwater, Fla. 34621

[21] Appl. No.: 443,627

[22] Filed: Nov. 29, 1989

[51] Int. Cl.[5] ..... F21V 21/22

[52] U.S. Cl. ..... 362/286; 362/289; 362/386; 362/394; 362/802

[58] Field of Search ..... 362/153, 153.1, 267, 362/285, 286, 289, 295, 386, 394, 802

[56] References Cited

U.S. PATENT DOCUMENTS 4,180,850 12/1979 Bivens ..... 362/385 X

*Primary Examiner*—Stephen F. Husar

*Attorney, Agent, or Firm*—Joseph C. Mason, Jr.; Ronald E. Smith

[57] ABSTRACT

An illumination device that is stored below ground level when not in use and that extends above the ground when in use. A clear lens that protects a light bulb from the elements surmounts an inner housing member that is telescopically received within an outer housing member that is buried in the ground. When a motor is activated, the inner housing that carries the light bulb extends axially upwardly from the outer housing. When the inner housing reaches its fully extended position, a limit switch shuts off the motor. Subsequent reactivation of the motor retracts the inner housing and bulb back into the outer housing, and another limit switch shuts off the motor when full retraction has been achieved. A second embodiment has an improved structure that facilitates replacement of the motor, and a third embodiment has a further improved structure that eliminates several parts required in the first and second embodiments.

10 Claims, 5 Drawing Sheets

ILLUMINATION DEVICE HAVING UNDERGROUND STORAGE POSITION

TECHNICAL FIELD

This invention relates, generally, to lighting devices of the type that illuminate walkways or other areas. More particularly, it relates to such a device that is retracted into the ground when not in use.

BACKGROUND ART

Lamps that are retracted into the ground when not in use are generally known. For example, U.S. Pat. No. 4,180,850 to Bivens shows a pop-up light that operates at the flick of a switch. Hydraulic pressure drives an inner housing out of a buried hollow housing, and a spring member is used to drive the extended part of the device back into the ground.

However, there remains a need for a retractable lamp of improved construction. The ideal device would extend into its operative configuration above the ground and retract into its stored configuration below the ground surface under the commands of a timer or a light level detecting means, would be sealed against the elements of nature by simple but effective means, and would be of elegant construction. Moreover, an ideal device would have means for shutting itself off if prevented by an obstacle from extending or retracting and would be easily repairable. However, the prior art, when considered as a whole, neither teaches nor suggests how the ideal retractable lamp could be provided.

DISCLOSURE OF INVENTION

The present invention includes an outer housing member, preferably of cylindrical construction, that is substantially buried in the ground but which has an upper end disposed in coplanar relation to the ground surface, and an inner housing member that is telescopically received within the outer housing member. The top of the inner housing is flat and also lies flush with the ground surface when the inner housing is fully retracted into the outer housing, so that the unit is protected from lawn mowers, the elements, and so that it does not cause tripping. In a first embodiment, the length of the inner housing is less than the length of the outer housing so that room is provided at the bottom of the outer housing for a small DC motor having an output shaft that rotates about its axis of rotation in a clockwise or counterclockwise direction. A double pole, double throw switch means is thrown to activate the motor. If the inner housing is retracted into the outer housing when the switch is thrown, the motor drives said inner housing upwardly into its fully extended position and an upper limit switch shuts off the motor when the inner housing achieves its fully extended position. If the inner housing is in its "up" position when the switch is thrown, the motor drives the inner housing downwardly into the outer housing, and a lower limit switch deactivates the motor when the inner housing is fully retracted.

An elongate, upstanding shaft is fixedly secured to or integrally formed with the output shaft of the motor, through a speed-reducing transmission means, for conjoint rotation therewith and said shaft rotates about its axis of rotation in the direction of output shaft rotation, which direction depends upon whether the inner housing is up or down. Helical worm gear threads (about eighteen threads to an eight inch shaft extent) are formed along most of the extent of the shaft, but the balance or lower part of the shaft is provided with closely spaced screw threads formed thereon. The number of worm gear threads per linear inch and the number of screw threads per linear inch are related by a predetermined ratio of about seven screw threads to one worm gear thread. The worm gear thread is engaged by a dedicated part of the inner housing (preferably, the bottom wall thereof) so that rotation of the worm gear drives the inner housing up or down dependent upon the direction of rotation.

The screw threads on the shaft are engaged by a nut that is held against rotation by a suitable nut holding means. The nut is free to travel axially along the extent of the screw threaded part of the shaft as the shaft rotates, but since the screw threads are more closely spaced than the worm gear threads, each rotation of the shaft will drive the inner housing up or down to a greater extent than each rotation will effect the axial position of the nut. The limit switches are positioned at opposite ends of the screw threaded part of the shaft and each limit switch cuts off the motor when cammingly contacted by the nut. The ratio of worm gear threads to screw threads is such that the nut will travel axially along the screw threaded part of the shaft from one limit switch to the other limit switch concomitantly with travel of the inner housing from its fully retracted or extended position to its opposite position.

A light bulb member is mounted at the top of the inner housing, and is shielded from the elements by a transparent lens member. A lid member also screw threadedly engages the upper end of the inner housing to allow access into the unit.

A number of critically positioned seal members are employed to protect the operative parts of the apparatus from the elements.

In a second embodiment, the motor is placed in a modular housing that is releaseably secured to the bottom wall of the outer housing, in depending relation thereto, so that if the motor fails, the housing may be replaced.

In a third embodiment, the screw-threaded part of the elongate shaft is eliminated, and other means are provided to shut the motor off as required.

The invention is new, useful, and was not obvious to those of ordinary skill in the art at the time it was made.

An important object of this invention is to advance the art of retractable illumination devices. More specific objects of the invention will be apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
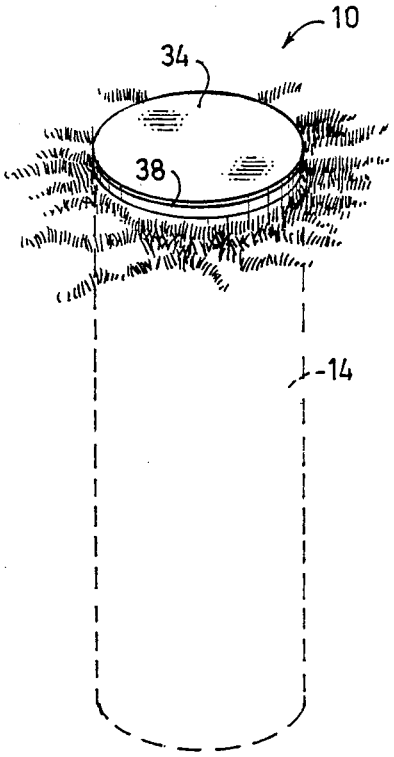
FIG. 1 is a perspective view of a ground surface showing the novel illumination device in its fully retracted configuration.

Referring now to FIG. 1, it will there be seen that the novel device 10 is substantially flush with the ground surface 12 when in its retracted state.

Figure 2:
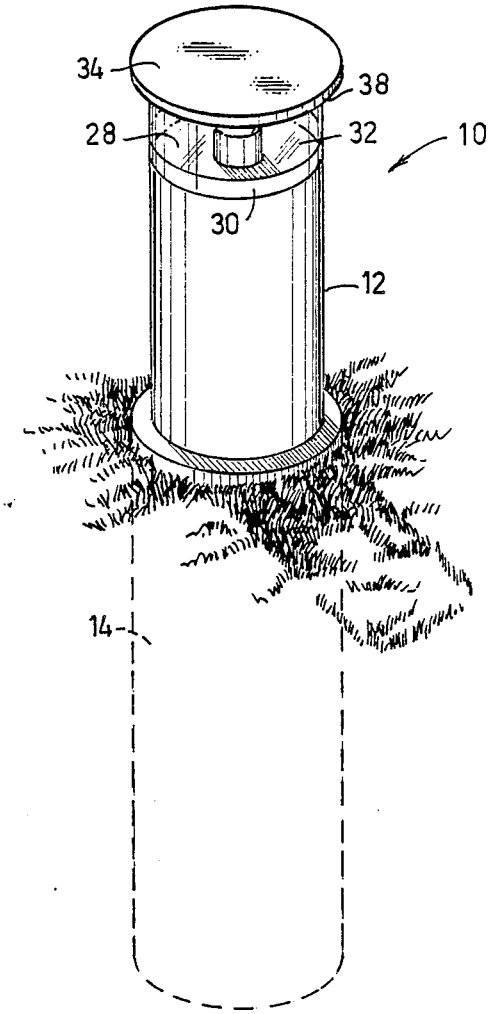
FIG. 2 is a view similar to that of FIG. 1, but showing the device in its fully extended configuration.

FIG. 2 depicts the pop-up light when in its extended or deployed configuration. Device 10 is there seen to include a pair of telescoping tubular housing members denoted 12 and 14.

Figure 4:
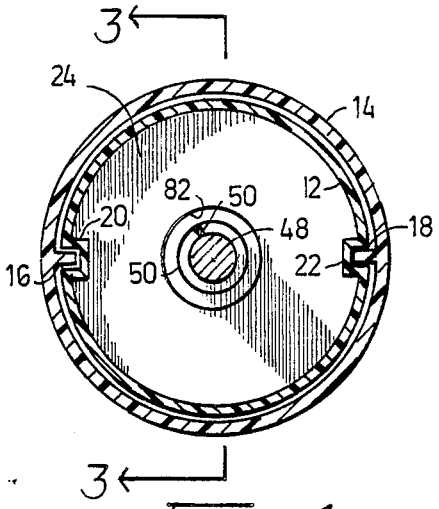
FIG. 4 is a transverse sectional view taken along line 4—4 in FIG. 3.

As best understood in connection with FIG. 4, inner tubular member 12 and outer tubular member 14 are keyed to one another so that inner member 12 may travel upwardly or downwardly with respect to outer member 14, which outer member is held against movement by the soil within which it is implanted. Inner housing 12 is held against rotation with respect to outer housing 14. More particularly, a pair of diametrically opposed, radially inwardly extending ridge member 16, 18 are formed along a preselected extent of outer housing 14 and a pair of complementally positioned channel members 20, 22 are formed along a preselected extent of the inner housing 12. Thus, the radially inwardly projecting ridge members 16, 18 form a key means and the complementally formed channels 20, 22 form a key way means.

Figure 3:
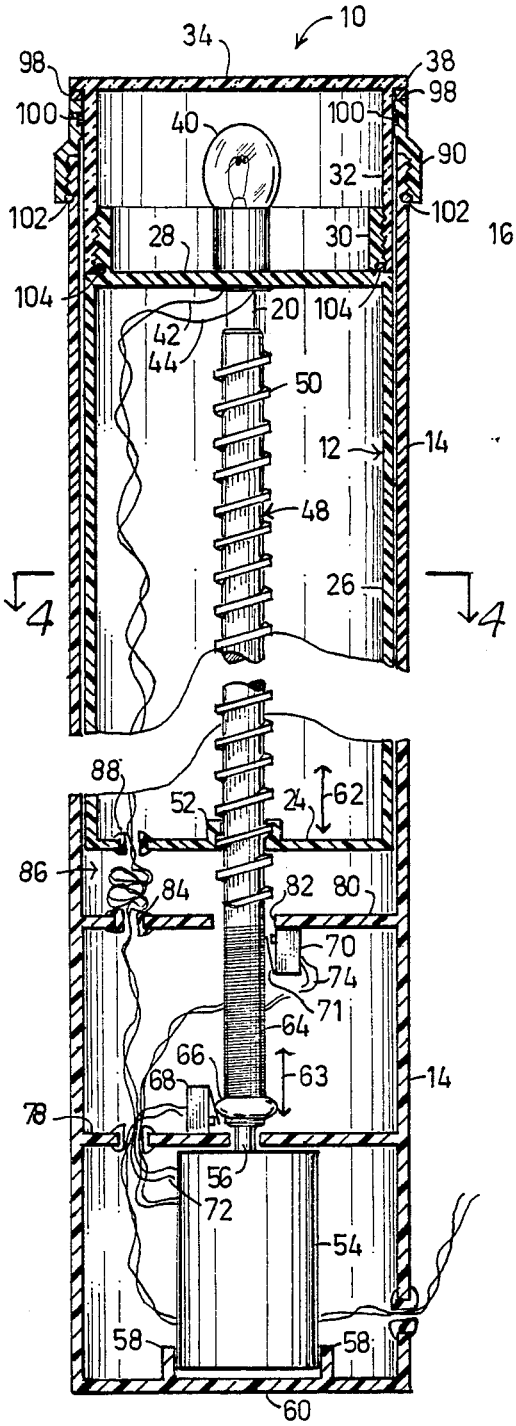
FIG. 3 is a longitudinal sectional view taken along line 3—3 in FIG. 4.

As perhaps best shown in FIG. 3, inner housing 12 includes a bottom wall 24, cylindrical side walls 26 mounted about the periphery thereof and projecting upwardly therefrom, an opaque top wall 28, and an externally threaded neck 30 integral with and projecting upwardly from said top wall 28 in concentric relation thereto, said neck 30 having a diameter only slightly less than the diameter of said inner housing 12 as shown.

A lens member having transparent side walls 32 which may be imperforate as shown or which may be of louvered construction surmounts inner housing 12 and is screwed threadedly engaged to neck 30 as shown. The lens includes an opaque top wall 34. Side walls 32 are concentrically disposed with respect to top wall 34, but are radially inwardly spaced from the peripheral edge 38 of top wall 34 as shown, i.e., the diameter of the side walls 32 is less than the diameter of top wall 34 so that an annular overhang is defined therebetween.

Light bulb 40 is housed interiorly of the lens member, substantially centrally thereof. Top wall 28 of inner housing 12 is centrally apertured to admit electrical leads 42, 44 to supply 12 volts DC power to light bulb 40.

An upstanding elongate shaft 48 is centrally disposed within device 10; its uppermost end is spaced just downwardly of bulb 40 as shown. A helical worm gear thread 50 is formed along a substantial extent of shaft 48. Interconnecting means 52 is formed in bottom wall 24 of inner housing 12 to cammingly interconnect said housing 12 and shaft 48 so that inner housing 12 is driven upwardly or downwardly dependent upon the direction of rotation of shaft 48.

Motor 54 having output shaft 56 and speed reducing gears, not shown, effects rotation of shaft 48 about its axis of rotation. Motor 54 is fixedly mounted to and held against rotation by retainer walls 58 that are integral with and project upwardly from bottom wall 60 of outer housing 14 as shown at the bottom of FIG. 3.

Accordingly, rotation of shaft 48 effects longitudinal travel of inner housing 12 in a direction determined by the direction of rotation of output shaft 56, as suggested by double-headed directional arrow 62.

Shaft 48 also includes a threaded base part having closely spaced screw threads 64 formed thereon. Nut 66 travels up and down along the extent of said threads 64, dependent upon the direction of output shaft rotation, as also indicated by arrow 63. The means for holding nut 66 against rotation, while allowing it to travel in either direction along the extent of screw threads 64, are not shown in FIG. 3 but such means could take a number of forms as those skilled in the art of machine design will appreciate.

FIG. 3 depicts nut 66 in its lowermost position; such position of nut 66 corresponds to the fully retracted position of inner housing 12 as depicted in FIGS. 1 and 3.

When in such lowermost position, nut 66 engages an outwardly biased lever associated with lower limit switch 68 by a cam action and said lever acts as a cam follower and activates the switch to shut off motor 54. The electrical leads that conductively couple switch 68 and motor 54 are collectively denoted 72.

It will be noted in FIG. 3 that worm gear threads 50 on shaft 48 are spaced much further apart than the threads 64 on the base of the shaft. There are about seven threads 64 for each thread 50. Thus, as shaft 48 rotates conjointly with output shaft 56, inner housing 12 will travel a greater axial distance per rotation than will nut 66. The ratio of threads per inch is selected so that when inner housing 12 has attained its fully extended position as depicted in FIGS. 2, nut 66 will have attained its uppermost position along the extent of threaded base 64. Such uppermost position will bring nut 66 into camming relation with an outwardly biased lever 71 associated with upper limit switch 70. Switch 70 is conductively coupled to motor 54 through electrical leads 74 so that motor 54 is shut off when inner housing 12 is fully extended.

Leads 72, 74, as well as output shaft 56, extend through respective apertures formed in wall 78 which serves as the support for lower limit switch 68. Upper limit switch 70 is similarly mounted to wall 80 that is spaced vertically from wall 78. Wall 80 is centrally apertured as at 82 to provide a passage way for shaft 48. Leads 42, 44 accumulate as shown in FIG. 3, between bottom wall 24 of inner housing 12 and wall 80 when inner housing 12 is fully retracted; the space or cavity means between said walls is denoted 86 in FIG. 3. The leads 42, 44 extend upwardly to bulb 40 through an aperture means 88 formed in wall 24 that forms the bottom wall of inner housing 12 and the upper wall of cavity means 86. Apertures 84 and 88 are formed in their respective walls 80 and 24 in axial alignment with one another so that leads 42, 44 are disposed in a substantially straight line when inner housing 12 is fully extended and so that a neat and untangled accumulation of said leads is formed when said inner housing 12 is fully retracted as shown, i.e., the alignment of apertures 84, 88 insures that leads 42, 44 will not become entangled around shaft 48.

The remaining but very important structural details of this embodiment of the invention are shown at the top of FIG. 3.

Lid member 90 is screw threadedly engaged to outer housing 14. More particularly, the lower part of lid 90 is internally threaded as shown and said threads screw threadedly engage external threads that circumscribe the outer surface of the uppermost end of outer housing 14. Therefore, to gain access into the unit, lid 90 is screw threadedly disengaged from outer housing 14.

There are four very important seals provided near the top of the novel structure.

An annular rubber seal 98 surmounts outer housing 14 and underlies the earlier-mentioned overhang defined by opaque top wall 34 and the transparent cylindrical side walls 32 depending therefrom.

An annular nylon seal 100 is spaced slightly downwardly therefrom and provides a low friction seal between the outer surface of side walls 32 and the inner surface of lid member 90. As clearly shown in FIG. 3, nylon seal 100 thus prevents soil, water or other forms of moisture from getting between the inner and outer housings 12 and 14.

A first "O" ring 102 is positioned at the lowermost part of lid 90 to provide a water tight seal between lid 90 and outer housing 14, and a second "O" ring 104 is positioned at the base of lens side walls 32 in circumscribing relation to neck 30 to effect a tight seal between side walls 32 and said neck.

Figure 5:
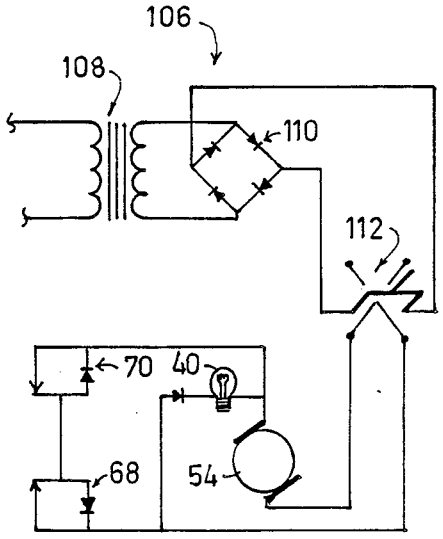
FIG. 5 is an electrical schematic diagram of the circuitry of the first embodiment of this invention.

The preferred electrical circuitry for this embodiment is shown in FIG. 5 and is denoted 106 as a whole.

Circuit 106 includes a step down transformer 108 that reduces the 115 volts AC current to 12 volts, and rectifier 110 that rectifies the AC current into DC current. A double pole double throw switch 112 feeds the low voltage DC current to motor 54, light bulb 40, and limit switches 68, 70 as shown. Thus, switch 112 is thrown into a first position when it is desired to extend inner housing 12 and to activate light bulb 40 and upper limit switch 70 obviates the need to throw the switch again to shut off motor 54 when the inner housing is fully extended. Similarly, when it is desired to lower or retract the inner housing, and to turn the light off, switch 112 is thrown to its second position, and lower limit switch 68 obviates the need to manually shut off motor 54 when inner housing 12 is fully retracted. Preferably, a timer switch (not shown) or a light level sensing means is employed to throw switch 112 to its first and second positions at the times or ambient light levels selected by the controller of device 10.

Figure 6:
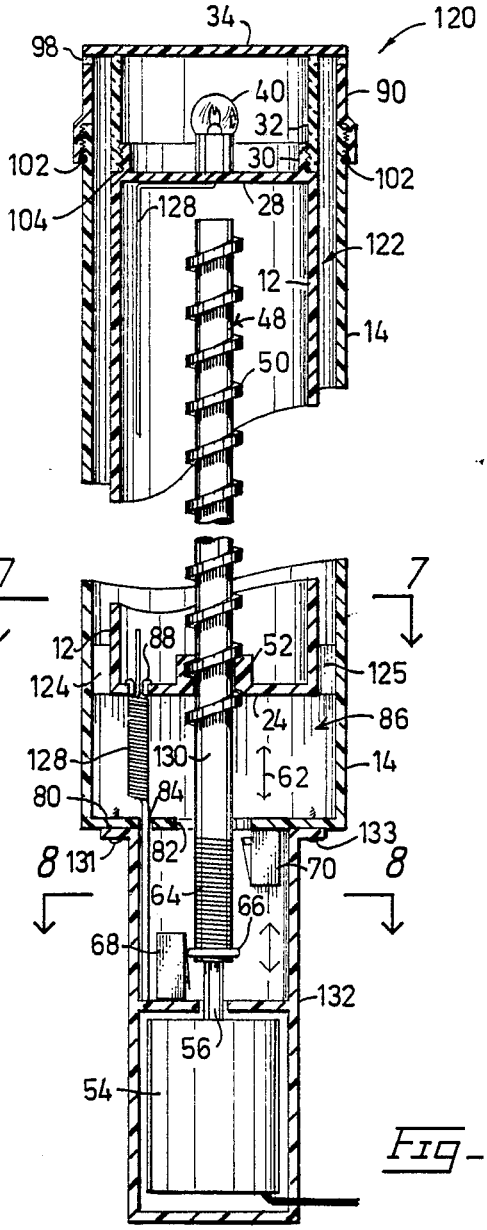
FIG. 6 is a longitudinal sectional view of a second embodiment of the invention.
Figure 7:
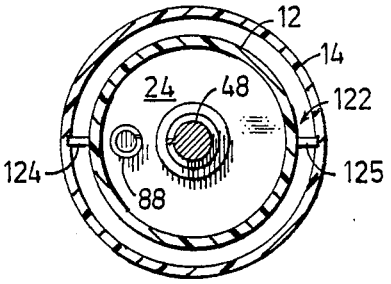
FIG. 7 is a transverse sectional view taken along line 7—7 in FIG. 6.
Figure 8:
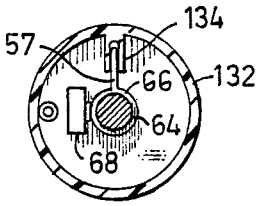
FIG. 8 is a transverse sectional view taken along line 8—8 in FIG. 6.

A second embodiment of the invention is shown in FIGS. 6–8, and is denoted by the reference numeral 120 as a whole. In this embodiment, inner tubular member 12 has a smaller diameter as depicted and, accordingly, there is a larger space 122 between tubes 12 and 14. A pair of diametrically opposed stabilizing means 124, 125 project radially outwardly from the lowermost end of inner tubular member 12 and each stabilizer rides in a small channel formed in the inner side wall of the outer housing as best shown in FIG. 7.

The electrical wires 128 that extend to bulb 40 are of the coiled type in this embodiment, i.e., they are of the type commonly used with telephones, dictation equipment, and the like. The coiled part thereof is positioned above bottom wall 80 of outer housing 14 and below bottom wall 24 of inner housing 12. This reduces the chances of an entanglement occurring when the device is in its retracted configuration as is clear from a comparison of FIGS. 3 and 6. A further reduction in entanglement probability is achieved by substantially eliminating the worm gear threads 50 below bottom wall 24 of inner housing 12 as denoted by the reference numeral 130.

To facilitate maintenance of unit 120, that part of the outer tubular member 14 below wall 80 is obviated and motor 54 and limit switches 68 and 70 are packaged in a modular unit 132 that is releaseably secured by screws 131, 133, or other suitable fastening means, to said bottom wall 80 in depending relation thereto. An "O"-ring, not shown, is employed to seal the modular unit or motor housing 132 from the elements. The releaseable attachment of the motor housing enables easy repair of the unit when the motor requires repair or replacement.

The means for holding nut 66 against rotation while still allowing it to travel axially is best shown in FIG. 8; however, it should be understood that the same means is employed in the first embodiment as well. Nut 66 includes an integral lug 67 that extends radially outwardly into a complementally formed lug-receiving channel formed in a base member 134 that is integral to the inner side wall of modular housing 132 as shown.

Figure 9:
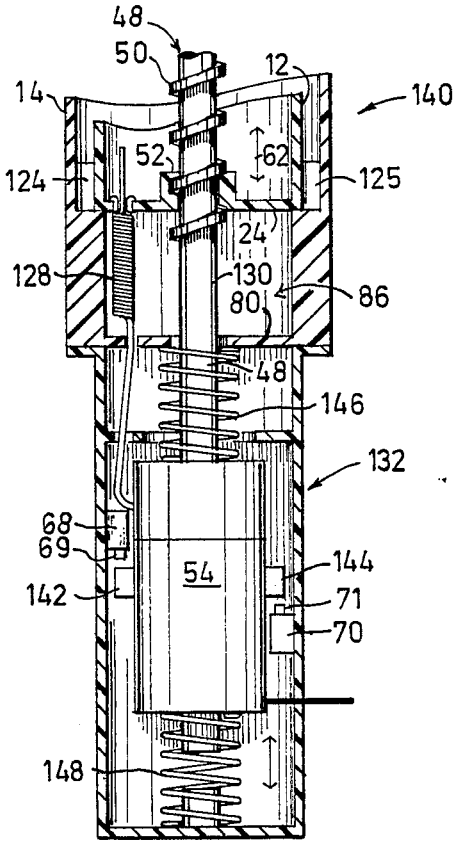
FIG. 9 is a partial longitudinal sectional view of a third embodiment.

A third embodiment of the invention is shown in FIG. 9 and is denoted 140 as a whole.

A pair of stop members 142, 144 are fixedly secured to motor 54 and extend radially outwardly therefrom in this embodiment. The motor is disposed in sandwiched relation between a pair of bias means in the form of upper coiled spring 146 and lower coiled spring 148 as depicted. Upper and lower limit switches 70, 68, respectively, are fixedly secured to the inner side wall of motor housing 132.

When the motor 54 is activated at a preselected time by a timer means, or other suitable means such as a light-level responsive means, rotation of elongate shaft 48 begins. If the output shaft of the motor rotates in a first direction that causes the inner housing 12 and lamp 40 to travel upwardly, and if such upward movement is unobstructed, neither spring 146, 148 will be substantially compressed or stretched and the inner housing 12 will rise as desired. When the fully extended position is achieved, continued rotation of the elongate shaft 48 will drive motor 54 downwardly, thereby compressing lower spring 148, until stop 144 abuts lever 71 of upper limit switch 70. When closed, said switch 70 deactivates the motor and lights lamp 40. Conversely, when elongate shaft 48 is rotating in the opposite direction, i.e., when inner housing 12 is being retracted into outer housing 14 at a preselected hour of the morning or at a preselected ambient light level, motor 54 will be in its equilibrium position as shown in FIG. 9 during the retraction procedure until the inner housing is fully retracted. Continued rotation of shaft 48 will then cause motor 54 to travel upwardly, compressing upper spring 146. When stop 142 closes lower limit switch 68 by abutting lever 69, the motor 54 and lamp 40 will be deactivated. In this manner, screw threads 64 at the base of shaft 48 are eliminated, along with nut 66, its lug 67 and the channel-defining base member 134 of the first and second embodiments.

If an individual is inadvertently standing atop top wall 34 when motor 54 is activated to raise the inner housing 12 and bulb 40, or if a heavy object has been left on top of the device, motor 54 will be driven downwardly just as if the inner housing were fully extended and the motor will be deactivated when stop 144 closes switch 70. Similarly, if an object is blocking the retraction of the inner housing 12 into outer housing 14, motor 54 will be deactivated upon stop 142 closing switch 68 just as if the retraction had been completed. Thus, not only does this novel arrangement obviate the need for the screw threads 64 and related parts as mentioned earlier, it also insures that the motor will not burn up if it is unable to extend or retract the inner housing in the substantial absence of opposition.

Figure 10:
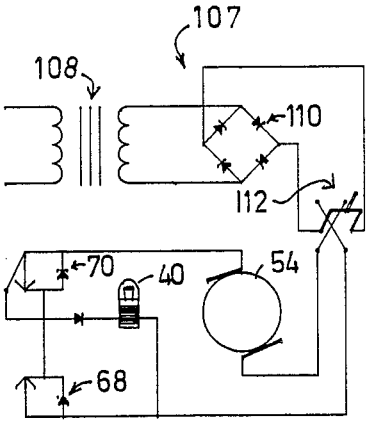
FIG. 10 is a schematic diagram of a second embodiment of the electrical circuit of this invention.

The circuitry associated with this embodiment is shown in FIG. 10; it should be understood that the circuitry of FIG. 10 could be employed in all three embodiments. Importantly, circuit 107 of FIG. 10 activates lamp 40 only when inner housing 12 is fully extended. This contrasts with circuit 106 of FIG. 5 which activates lamp 40 as soon as inner housing 12 begins traveling upwardly. Thus, circuit 107 conserves power during the extension procedure. Moreover, circuit 107 deactivates the lamp as soon as the retraction procedure begins, whereas circuit 106 does not deactivate lamp 40 until the retraction is completed.

Figure 11:
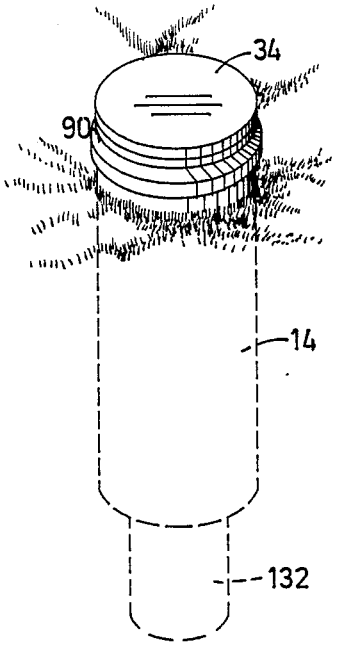
FIG. 11 is a view similar to that of FIG. 1, but showing the invention disposed partly above the ground.
Figure 12:
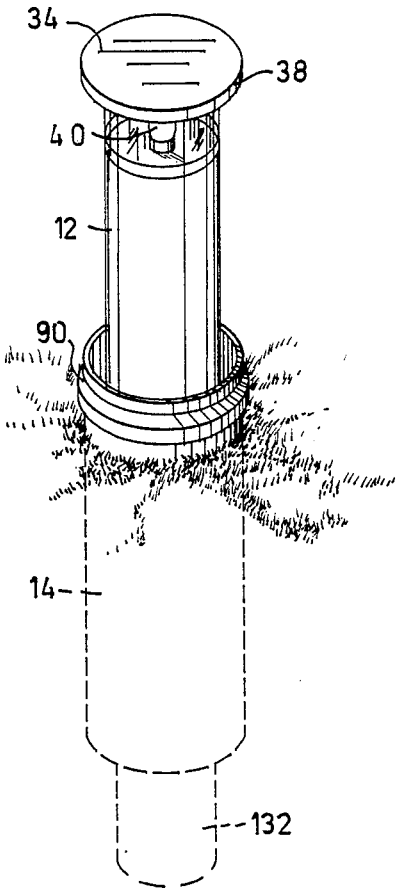
FIG. 12 is a perspective view showing the device of FIG. 11 in its extended configuration.

FIGS. 11 and 12 show the second and third embodiments when operatively installed. In this particular installation, top wall 34 and lid 90 project upwardly above the ground surface as shown to facilitate the grasping of said lid 90. The first embodiment also includes lid 90, but it has not been shown in FIGS. 1 and 2 to simplify those drawings.

The advantages of this invention clearly provide an important advance in the art of retractable landscape lighting devices.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover of all the generic and specific features of the invention herein described, and all statements of the scope of the invention which, as a matter of language, might be said to fall therebetween.

Now that the invention has been described,

What is claimed is:

1. A device that provides above ground illumination when in use and which retracts into the ground when not in use, comprising:

an outer housing having a predetermined extent;

said outer housing being substantially buried in the ground in substantially orthogonal relation to a ground surface;

said outer housing having an upper end disposed in substantially flush relation to said ground surface;

an inner housing having a predetermined extent less than the predetermined extent of said outer housing;

said inner housing being telescopically received within said outer housing;

a motor disposed interiorly of said outer housing;

a switch for activating said motor;

said motor having an output shaft;

an elongate worm gear being fixedly secured to and conjointly rotatable with said output shaft;

said worm gear having a first part, of a first predetermined extent, having a helical worm gear thread formed along said first predetermined extent, said worm gear thread having a first predetermined number of threads per inch;

said worm gear including a second part, of a second predetermined extent, having screw threads formed along said second predetermined extent, said screw threaded second part having a second predetermined number of threads per inch;

said second predetermined number of threads per inch on said second part being greater than the predetermined number of threads per inch on said first part and being related thereto by a predetermined ratio;

interconnecting means for interconnecting said worm gear thread and said inner housing so that rotation of said worm gear about its axis of rotation effects axial displacement of said inner housing in an axial direction dependent upon the direction of rotation of said worm gear;

a nut means screw threadedly engaged with the screw threads formed on said second part;

a nut holding means for holding said nut means against rotation as said worm gear means rotates about its axis of rotation while permitting axial travel of said nut means along the extent of said second part of said worm gear means, said direction of axial travel of said nut means being dependent upon the direction of rotation of said worm gear means;

a first limit switch positioned adjacent a first end of said second part;

a second limit switch positioned adjacent a second end of said second part;

a light bulb mounted in surmounting relation to said inner housing member;

said light bulb being electrically connected to said motor;

whereby activation of said motor effects axial travel of said light bulb until a limit switch stops said travel; and whereby activation of said motor also activates or deactivates said light bulb.

2. The device of claim 1, wherein said nut means includes an integrally formed lug member that projects outwardly from said nut means, and wherein said nut holding means includes a base member attached to an inner wall of said outer housing and a channel formed in said base member, said channel being specifically configured and dimensioned to slideably receive said lug member therein.

3. The device of claim 2, further comprising a housing for said light bulb, said housing including a transparent side wall that surrounds the light bulb and an opaque top wall that surmounts said side wall.

4. A device that provides above ground illumination when in use and which retracts into the ground when not in use, comprising:

an elongate, tubular outer housing having an upper end substantially coplanar with a ground surface when operatively installed;

an elongate, tubular inner housing telescopically received within said outer housing;

a motor having an output shaft;

a motor housing;

said motor housing being releaseably secureable to said outer housing in depending relation thereto;

a pair of limit switches being disposed in said motor housing, said pair of limit switches including an upper limit switch mounted within said motor housing near a top end thereof and a lower limit switch mounted within said motor housing near a bottom end thereof;

a light bulb;

a housing for said light bulb;

said light bulb and said housing being disposed in surmounting relation to said inner housing;

said housing for said light bulb having an opaque top wall and transparent, cylindrical side walls depending therefrom;

an elongate shaft having worm gear threads formed along a first, upper extent thereof and having screw threads formed along a second, lower extent thereof;

said elongate shaft being fixedly secured to and conjointly rotable with said output shaft of said motor;

interconnecting means for interconnecting said inner housing and the worm gear threads formed in said elongate shaft so that motor-driven rotation of said output shaft effects axial displacement of said inner housing and hence of said light bulb and said light bulb housing;

a switch that when closed activates said motor and that when open deactivates said motor;

a nut that screw threadedly engages the screw threads formed along the lower extent of said elongate shaft;

a lug integral with said nut that projects outwardly therefrom;

a channel that slideably receives said lug and that prevents rotation of said nut when said elongate shaft is rotated by said output shaft;

said channel being formed in a base member secured to an inner wall of said motor housing;

said nut traveling along the extent of said screw threaded part of said elongate shaft in response to rotation of said elongate shaft;

said nut closing said upper limit switch when said nut travels to an upper end of said screw threaded part;

said nut closing said lower limit switch when said nut travels to a lower end of said screw threaded part;

said upper limit switch being electrically connected to said motor and to said light bulb such that said motor is deactivated and said light bulb is activated when said nut closes said upper limit switch; and said lower limit switch being electrically connected to said motor and to said light bulb such that said motor and said light bulb are deactivated when said nut closes said lower limit switch.

5. The device of claim 4, wherein said top wall of said inner housing is disposed in substantially coplanar relation to a ground surface when said inner housing is fully retracted into said housing and when said device is operatively installed.

6. The device of claim 5, wherein said interconnecting means is a cam that cammingly engages the worm gear threads formed on said shaft, said cam being integral to a bottom wall of said inner housing.

7. A device that provides above ground illumination when in use and which retracts into the ground when not in use, comprising:

an outer housing disposed substantially beneath a ground surface when said device is operatively installed;

an inner housing telescopically received within said outer housing;

an elongate, vertically disposed worm gear member that cammingly engages a bottom wall of said inner housing so that said inner housing is driven upwardly or downwardly dependent upon the direction of rotation of said worm gear member;

a motor having an output shaft, said output shaft being integrally formed with said worm gear member so that rotation of said output shaft effects conjoint rotation of said worm gear member;

a motor housing having a bottom wall and side walls, said motor housing being releaseably secured to and depending from said outer housing;

a first bias means being disposed between a bottom of said outer housing and a top end of said motor;

a second bias means being disposed between a bottom end of said motor and a bottom wall of said motor housing;

a first stop member fixedly secured to said motor, said first stop member projecting radially outwardly therefrom;

a second stop member fixedly secured to said motor, said second stop member projecting radially outwardly therefrom;

said first and second stop members being circumferentially spaced apart from one another;

an upper limit switch fixedly secured to a side wall of said motor housing in vertically spaced relation below said first stop member;

a lower limit switch fixedly secured to a side wall of said motor housing in vertically spaced relation above said second stop member;

said upper limit switch and said lower limit switch being independently electrically connected to said motor and being operative to deactivate said motor when contacted by said first and second stop members, respectively;

whereby said motor is deactivated when a substantial resistance to extension or retraction of said inner housing is encountered.

8. The device of claim 7, further comprising a light bulb disposed in surmounting relation to said inner housing and an elongate coiled wire that electrically interconnects said light bulb and a source of power.

9. The device of claim 8, wherein said upper and lower limit switches are electrically connected to said motor and to said light bulb.

10. The device of claim 9, wherein said elongate coiled wire has a coiled section disposed below a bottom wall of said inner housing and above a bottom wall of said outer housing.

* * * * *